US012540047B2

(12) United States Patent
Suzuki

(10) Patent No.: US 12,540,047 B2
(45) Date of Patent: Feb. 3, 2026

(54) SHEET CONVEYANCE DEVICE

(71) Applicant: CANON KABUSHIKI KAISHA, Tokyo (JP)

(72) Inventor: Yoshimi Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 194 days.

(21) Appl. No.: 18/490,566

(22) Filed: Oct. 19, 2023

(65) Prior Publication Data

US 2024/0132313 A1 Apr. 25, 2024
US 2024/0228207 A9 Jul. 11, 2024

(30) Foreign Application Priority Data

Oct. 24, 2022 (JP) ..... 2022-169648

(51) Int. Cl.
*B65H 5/06* (2006.01)

(52) U.S. Cl.
CPC ..... *B65H 5/062* (2013.01); *B65H 2404/144* (2013.01); *B65H 2404/17* (2013.01)

(58) Field of Classification Search
CPC ..... B65H 2404/17; B65H 2404/144; B65H 2404/172
See application file for complete search history.

(56) References Cited

U.S. PATENT DOCUMENTS 6,267,373 B1 * 7/2001 Takata ..... B65H 5/06 403/111
12,091,277 B2 * 9/2024 Nakatomi ..... B65H 5/06

FOREIGN PATENT DOCUMENTS

JP H10120235 A 5/1998
JP H11227977 A 8/1999
JP 2016132544 A 7/2016

* cited by examiner

*Primary Examiner* — Howard J Sanders
(74) *Attorney, Agent, or Firm* — Canon U.S.A., Inc. IP Division

(57) ABSTRACT

A sheet conveyance device includes a frame, first and second rollers, a roller shaft, an urging member, and a bearing. The bearing includes a holding portion to slidably hold the roller shaft and held by the frame. The holding portion is deformable. As viewed in a rotational axis direction of the roller shaft, a direction in which the urging member urges the second roller is defined as a first direction, a direction that is perpendicular to the first direction is defined as a second direction, and a region where the roller shaft is present in the second direction is defined as a first region. The frame holds the bearing so as not to be in contact with the holding portion in the first region downstream of a rotation center of the roller shaft in the first direction.

8 Claims, 9 Drawing Sheets

SHEET CONVEYANCE DEVICE

BACKGROUND

Field

The present disclosure relates to a sheet conveyance device that conveys a sheet.

Description of the Related Art

In a sheet conveyance device and an image forming apparatus, such as an electrophotographic image forming apparatus, including a sheet conveyance device, a technique has been developed in which a recording medium (a sheet) is conveyed while being nipped by a pair of facing rollers that are rotating. In this case, as described in Japanese Patent Laid-Open No. 2016-132544, a technique is known in which a roller shaft having a roller attached thereto is slidably held by a bearing.

In one of structures of a roller shaft and a bearing, a cylindrical bearing having a hole formed therein holds a columnar roller shaft with the same diameter as the hole. In this case, in consideration of dimensional tolerances and the like, the diameter of the hole in the bearing is greater than the diameter of the roller shaft, and a gap is formed between the bearing and the roller shaft.

In the sheet conveyance device, the bearing sometimes abrades away in a sliding section where the bearing holds the roller shaft.

SUMMARY

The present disclosure provides a sheet conveyance device including a bearing to prevent a decrease in the contact area between the roller shaft and the bearing and, thus, prevent abrasion of the bearing.

According to an aspect of the present disclosure, a sheet conveyance device includes a frame, a first roller configured to convey a sheet, a roller shaft configured to hold the first roller, a second roller configured to face the first roller and nip the sheet together with the first roller, an urging member configured to urge the second roller toward the first roller in a direction intersecting a rotational axis direction of the roller shaft, and a bearing including a holding portion configured to slidably hold the roller shaft and held by the frame, wherein the holding portion is deformable, wherein, as viewed in the rotational axis direction of the roller shaft, a direction in which the urging member urges the second roller is defined as a first direction, a direction that is perpendicular to the first direction is defined as a second direction, and a region where the roller shaft is present in the second direction is defined as a first region, and wherein the frame holds the bearing so as not to be in contact with the holding portion in the first region downstream of a rotation center of the roller shaft in the first direction.

Further features of the present disclosure will become apparent from the following description of exemplary embodiments with reference to the attached drawings.

DESCRIPTION OF THE EMBODIMENTS

Exemplary embodiments of the present disclosure are described below with reference to the accompanying drawings.

First Embodiment

A sheet conveyance device according to the first embodiment is described below with reference to FIGS. 1 and 2.

Figure 1:
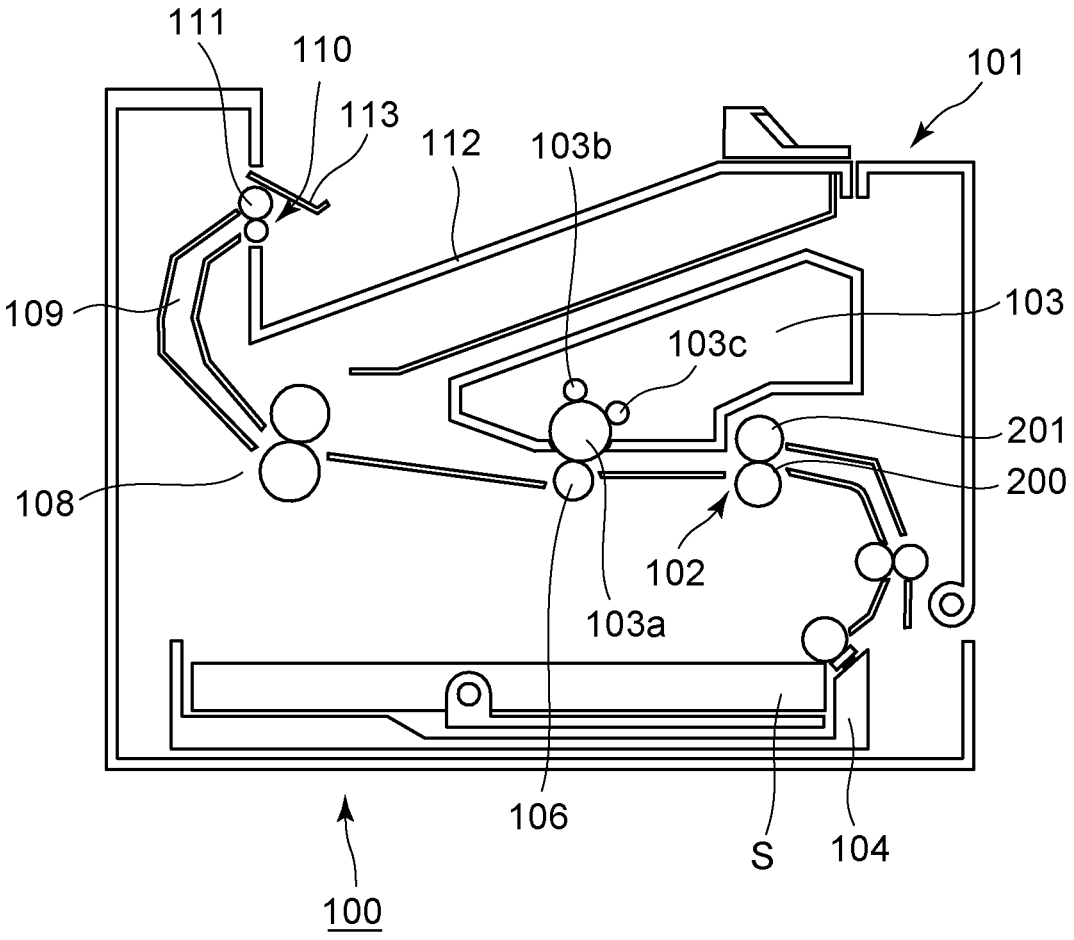
FIG. 1 is a cross-sectional view of an image forming apparatus including a sheet conveyance device according to a first embodiment.

FIG. 1 is a cross-sectional view of an image forming apparatus 100 including a sheet conveyance device according to the first embodiment. The image forming apparatus 100 forms an image on a sheet S using the electrophotographic technique. FIG. 2 is a perspective view of a conveyance roller unit 102.

The image forming apparatus 100 includes a sheet feeding cassette 104 serving as a sheet storage unit. The sheet feeding cassette 104 is configured to be removable from an apparatus body 101 of the image forming apparatus 100. When a print start signal is received, the sheets S stacked in the sheet feeding cassette 104 are conveyed one by one to the downstream of a sheet conveyance direction of the image forming apparatus 100.

A portion of the image forming apparatus 100 that has functions related to the conveyance of the sheet S can be referred to as a "sheet conveyance device". The sheet conveyance device according to the first embodiment includes a conveyance roller unit 102. The conveyance roller unit 102 includes a drive roller 200*a* serving as a first roller and a driven roller 201*a* serving as a second roller. The drive roller 200*a* is held by a drive roller shaft (a first roller shaft, a roller shaft) 200*b*, and the driven roller 201*a* is held by a driven roller shaft 201*b* (a second roller shaft). The drive roller 200*a* and the drive roller shaft 200*b* are part of the drive roller unit 200, and the driven roller 201*a* and driven roller shaft 201*b* are part of the driven roller unit 201.

Figure 2:
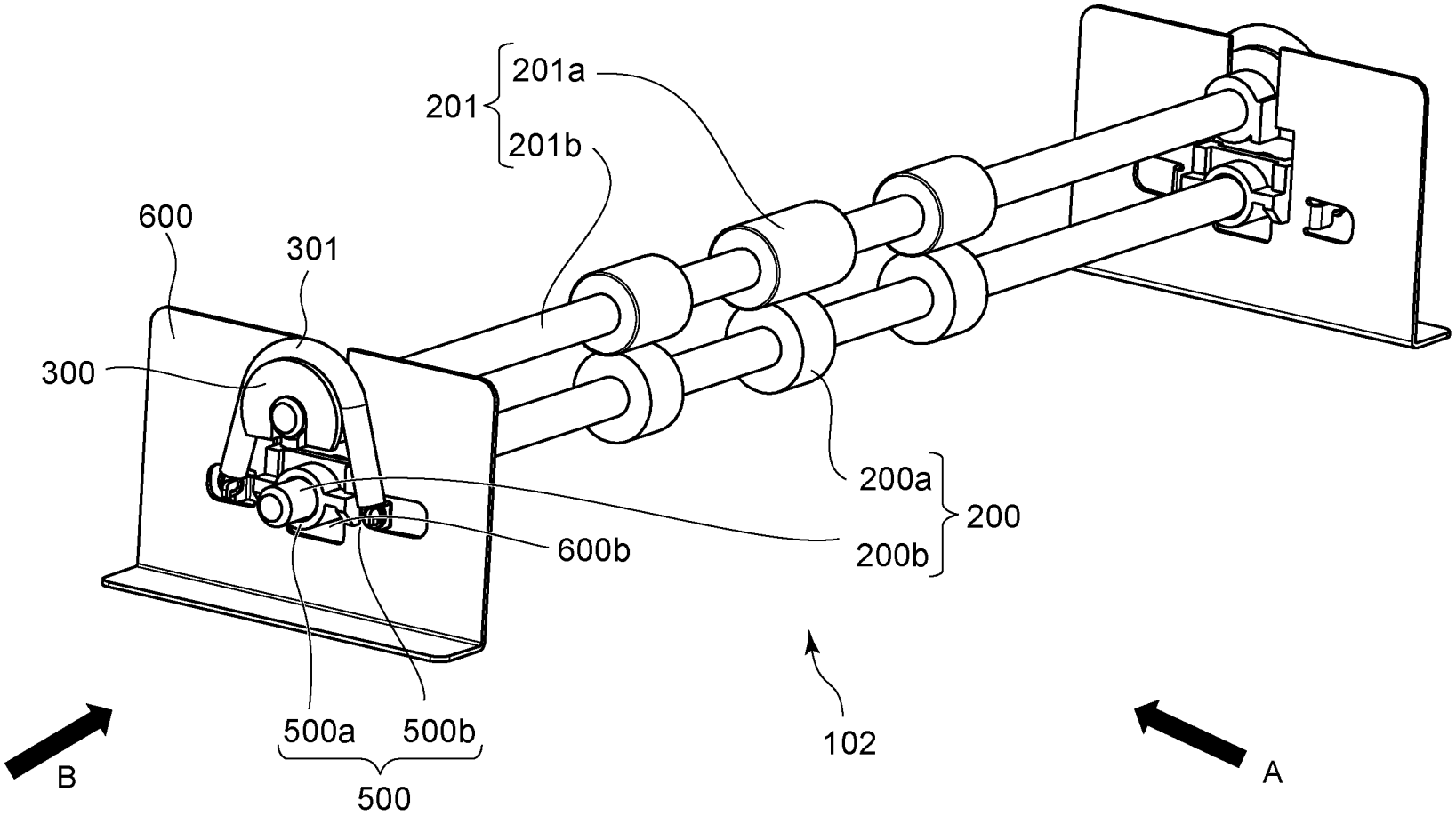
FIG. 2 is a perspective view of a conveyance roller unit according to the first embodiment.

As illustrated in FIG. 2, a spring receiving unit 300 is attached to the end of the driven roller shaft 201*b*, and a spring 301 serving as an urging member bridges over the spring receiving unit 300. In a direction intersecting (preferably, perpendicularly) the rotational axis direction of the drive roller shaft 200*b*, the spring 301 urges the driven roller 201*a* toward the drive roller 200*a* via the spring receiving unit 300 and the driven roller shaft 201*b*. The direction in which the spring 301 urges the driven roller 201*a* as viewed in the rotational axis direction of the drive roller shaft 200*b* is referred to as a "first direction".

The driven roller 201*a* is urged toward the drive roller 200*a* by the spring 301 and is brought into contact with the drive roller 200*a* to form a nip with the drive roller 200*a*. The rotational axis direction of the drive roller shaft 200*b* is parallel to the rotational axis direction of the driven roller shaft 201*b*.

The drive roller 200*a* receives driving force from a drive source (not illustrated) to perform rotational driving operation. When a sheet S is fed from the sheet feeding cassette 104, the sheet S is held between the drive roller 200*a* and the driven roller 201*a*. Then, the drive roller 200*a* performs rotational driving operation and, thus, the sheet S is conveyed toward the nip portion (an image forming section) between the transfer roller 106 and the photosensitive drum 103*a* (described below).

More specifically, the drive roller 200*a* and the driven roller 201*a* are located upstream of the image forming section in a conveyance path of the sheet S and form a registration roller pair that corrects skew of the sheet S. The image forming apparatus 100 includes a process cartridge 103 that is removable from the image forming apparatus 100. The process cartridge 103 includes a photosensitive drum 103*a* serving as an image bearing member, a charging roller 103*b* serving as a charging unit, and a developing roller 103*c* serving as a toner image developing unit.

The transfer roller 106 is urged toward the photosensitive drum 103*a* and is drivenly rotated by the rotation of the photosensitive drum 103*a*. The photosensitive drum 103*a* having the developed toner image thereon and the transfer roller 106 nips the sheet S conveyed from the sheet feeding cassette 104 and transfer the toner image onto the sheet S.

The sheet S having the toner image transferred thereon is conveyed to a fixing unit 108. The fixing unit 108 heats and pressurizes the sheet S to fix the transferred toner image onto the sheet S. The sheet S having the toner image fixed thereto is discharged through a sheet conveyance path 109 by a discharge roller pair 111 provided at a sheet discharge port 110. The discharged sheet S is stacked on a sheet discharge tray 112 serving as a sheet stacking unit.

Figure 3A:
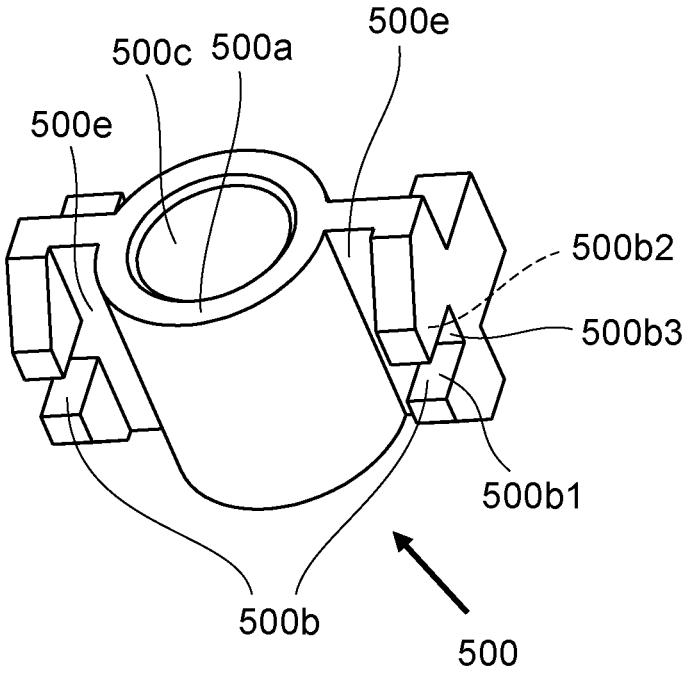
FIGS. 3A and 3B are perspective views of a bearing according to the first embodiment.
Figure 3B:
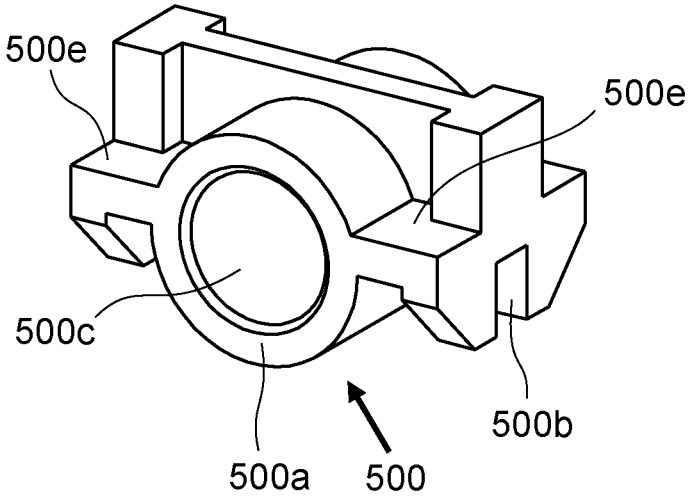

The drive roller shaft 200*b* is held by a deformable bearing 500 at both ends. The structure of the bearing 500 and the mounting structure of the bearing 500 according to the first embodiment are described with reference to FIGS. 3A to 6B. FIGS. 3A and 3B are perspective views of the bearing 500. FIGS. 3A and 3B illustrate the bearing 500 from different angles. According to the first embodiment, the bearing 500 is made of a sliding resin material. However, the material of the bearing 500 is not limited thereto.

A cylindrical portion (a receiving portion) 500*a* is part of the bearing 500 and holds the drive roller shaft 200*b*. The cylindrical portion 500*a* can be elastically deformable. It is desirable that the material of the bearing 500 be resin. The bearing 500 includes arms 500*e* formed to extend from the cylindrical portion 500*a*, and each of the arms 500*e* has a slit 500*b* formed therein. The slit 500*b* engages with a frame 600 (described below) and, thus, the bearing 500 is held by the frame 600. The slit 500*b* is located at the substantial center of the cylindrical portion 500*a* in the rotational axis direction of the drive roller shaft 200*b*.

The location of the center of the cylindrical portion 500*a* and the location of the slit 500*b* overlap with each other in the rotational axis direction of the drive roller shaft 200*b*.

The bearing 500 has a first surface 500*b*1, a second surface 500*b*2 opposite the first surface 500*b*1, and a third surface 500*b*3 extending in a direction intersecting (preferably, perpendicularly) the first direction. The first surface 500*b*1, a second surface 500*b*2, and the third surface 500*b*3 form the slit 500*b*. The third surface 500*b*3 is in contact with the frame 600 such that the bearing 500 is positioned in place on the frame 600 in the first direction. When the bearing 500 is positioned in place on the frame 600, the first surface 500*b*1 and the second surface 500*b*2 face each other so as to sandwich the frame 600.

The first surface 500*b*1 regulates the displacement of the bearing 500 from the frame 600 in a direction from the drive roller 200*a* toward the frame 600 along the rotational axis of the drive roller shaft 200*b*. The second surface 500*b*2 regulates the displacement of the bearing 500 from the frame 600 in a direction from the frame 600 toward the drive roller 200*a* along the rotational axis of the drive roller shaft 200*b*.

The first surface 500*b*1 and the second surface 500*b*2 are disposed downstream of the third surface 500*b*3 in the first direction. A hole 500*c* is formed in the center of the cylindrical portion 500*a*, and the drive roller shaft 200*b* is inserted into the hole 500*c*. As a result, the bearing 500 supports the drive roller shaft 200*b*.

Figure 4A:
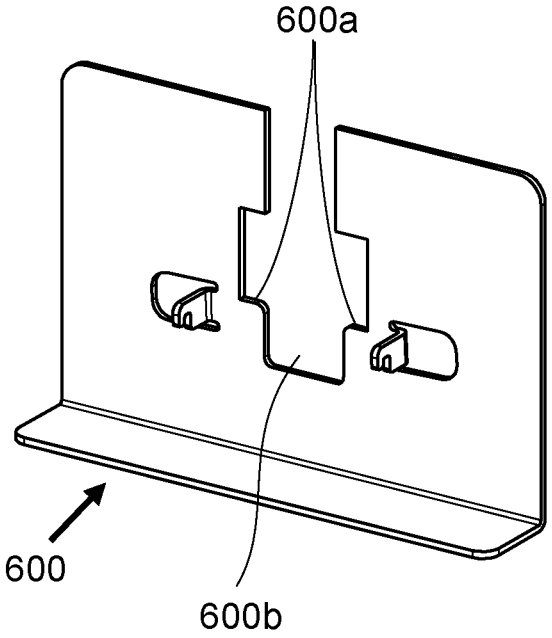
FIGS. 4A and 4B are perspective views of a frame according to the first embodiment.
Figure 4B:
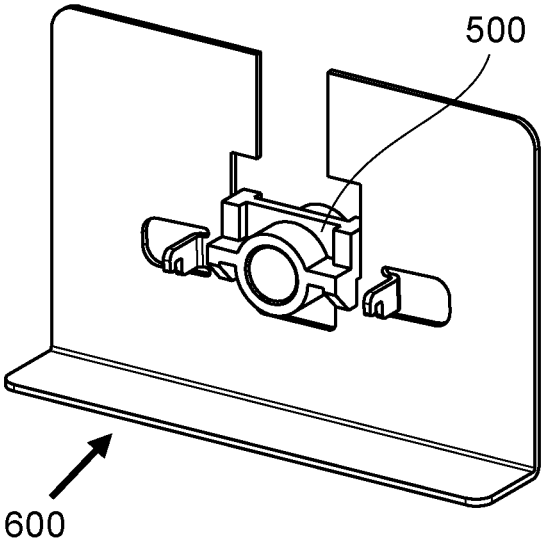

FIGS. 4A and 4B are perspective view of the frame 600 that holds the bearing 500. FIG. 4A illustrates the frame 600, and FIG. 4B illustrates the frame 600 and the bearing 500 held by the frame 600. An engagement portion 600*a* is configured to engage with the slit 500*b* of the bearing 500 so as to position the bearing 500. More specifically, the engagement portion 600*a* is engaged with the slit 500*b* so that the first surface 500*b*1 and the second surface 500*b*2 sandwiches the engagement portion 600*a*. Space 600*b* is intentionally provided so as to be formed when the frame 600 and the bearing 500 are engaged. The effect of the space 600*b* is described in detail below.

Figure 5A:
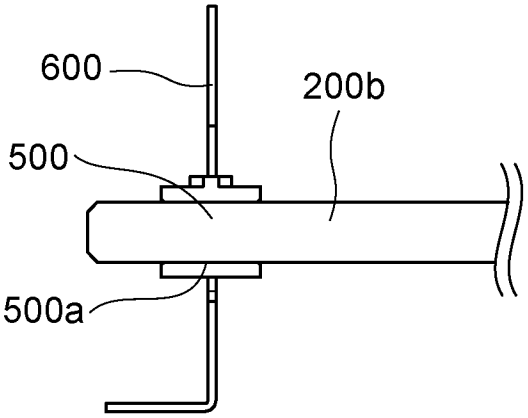
FIGS. 5A and 5B are schematic illustrations of the bearing and its vicinity viewed from direction A in FIG. 2, according to the first embodiment.
Figure 5A:
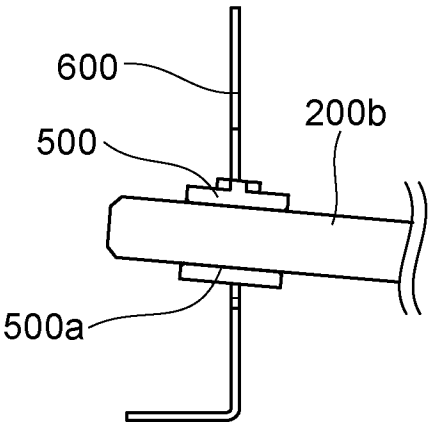
Figure 5A:
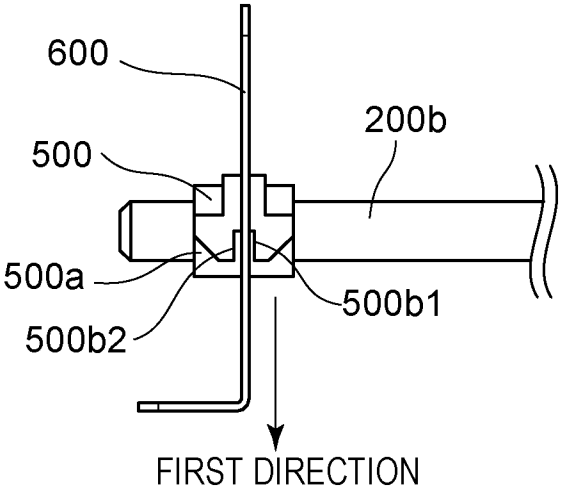
Figure 5B:
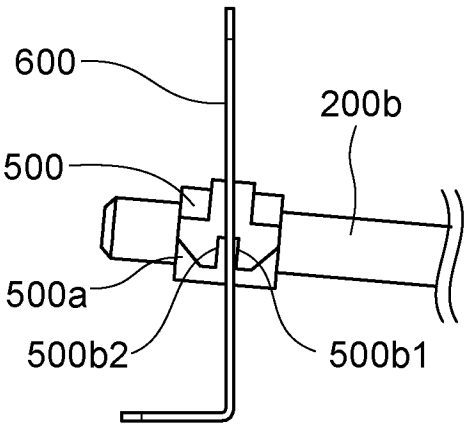

A structure that increases the contact area between the drive roller shaft 200*b* and the bearing 500 in the longitudinal direction of the drive roller shaft 200*b* is described with reference to FIGS. 5A and 5B. FIGS. 5A and 5B are schematic illustrations of the bearing 500 and its vicinity as viewed in direction A (perpendicular to the rotational axis direction of the drive roller shaft 200*b*) illustrated in FIG. 2. FIG. 5A is an external view and a cross-sectional view of the bearing 500 that is not tilted, and FIG. 5B is an external view and a cross-sectional view of the bearing 500 that is tilted.

The drive roller shaft 200*b* receives a force of the spring 301 from the driven roller 201*a*. The force causes the drive roller shaft 200*b* to bend. When the drive roller shaft 200*b* is bent, the contact area between the inside of the hole 500*c* and the drive roller shaft 200*b* decreases in the longitudinal direction of the drive roller shaft 200*b* and, therefore, the contact area between the hole 500*c* and the drive roller shaft 200*b* easily abrades away. According to the first embodiment, the bearing 500 is configured to tilt in accordance with the bend of the drive roller shaft 200*b* in such a situation. The structure that causes the bearing 500 to tilt is described below.

The relationship among the above-described first surface 500*b*1, second surface 500*b*2, and engagement portion 600*a* is described in more detail below. According to the first embodiment, the first surface 500*b*1, the second surface 500*b*2, and the engagement portion 600*a* are disposed so that when one of the first surface 500*b*1 and the second surface 500*b*2 is in contact with the frame 600, a gap is formed between the other of the first surface 500*b*1 and the second surface 500*b*2 and the frame 600. That is, the gap of the slit 500*b* (the distance between the first surface 500*b*1 and the second surface 500*b*2) is greater than the thickness of the frame 600. This allows the bearing 500 to tilt as illustrated in FIGS. 5A and 5B while being engaged with and held by the frame 600.

More specifically, if the bearing 500 is configured to be able to tilt 1° to 15° from the frame 600, the contact area between the drive roller shaft 200*b* and the bearing 500 increases, which easily achieves the desired effect.

In addition, according to the first embodiment, the slit 500*b* is provided on only one side in the urging direction of the spring 301 so that the bearing 500 can easily be tilted. More precisely, the third surface 500*b*3 that positions the bearing 500 on the frame 600 is provided to face downstream in the first direction.

On the upstream side of the third surface 500*b*3 in the first direction, the displacement of the bearing 500 from the frame 600 in the rotational axis direction of the drive roller shaft 200*b* is not regulated. Therefore, as illustrated in FIG. 5B, when the driven roller 201*a* is urged by the spring 301 and the drive roller shaft 200*b* is bent, part of the bearing 500 is allowed to be displaced from the frame 600 in the direction from the frame 600 to the drive roller 200*a* on the upstream side of the third surface 500*b*3 in the first direction.

When the drive roller shaft 200*b* is bent and the bearing 500 is tilted in this manner, the contact area between the drive roller shaft 200*b* and the bearing 500 in the longitudinal direction of the drive roller shaft 200*b* is greater than when the bearing 500 is not tilted and, thus, the bearing 500 is less likely to abrade away. Also, the temperature is less likely to increase.

Figure 6A:
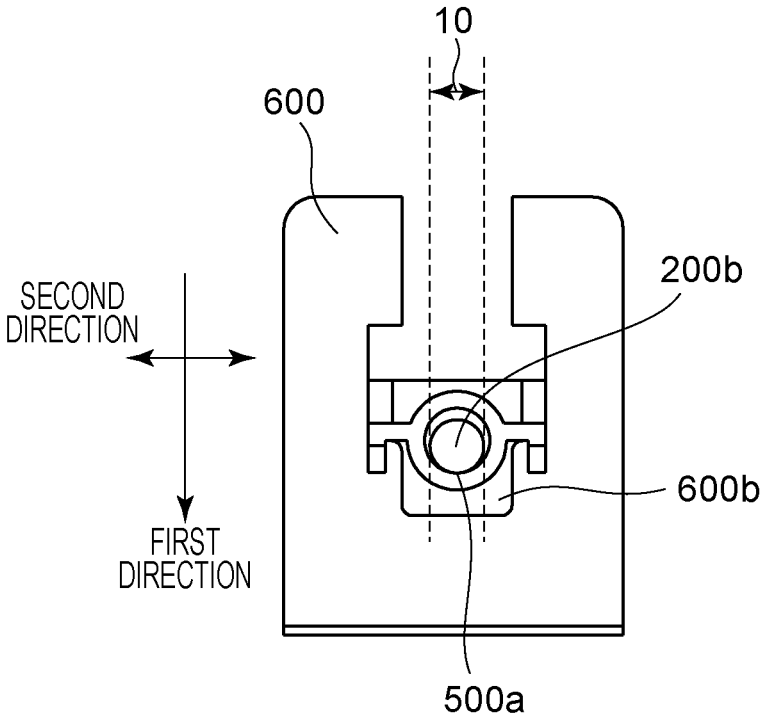
FIGS. 6A and 6B are cross-sectional views of a bearing and its vicinity viewed in the extension direction of the drive roller shaft, according to the first embodiment.
Figure 6B:
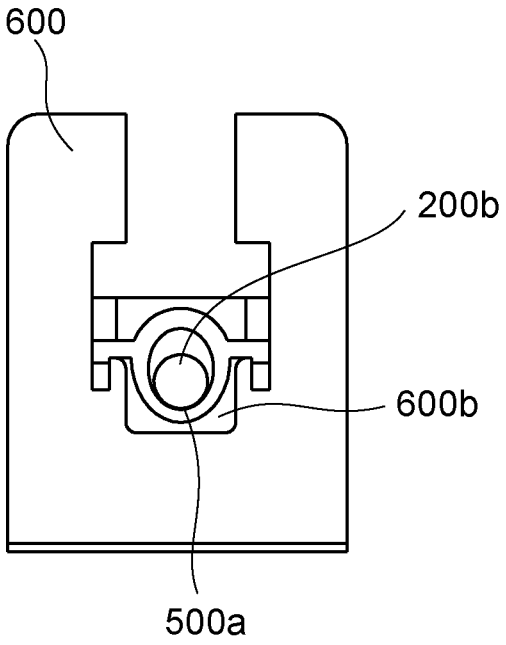

The structure that increases the contact area between the drive roller shaft 200*b* and the bearing 500 in the circumferential direction of the drive roller shaft 200*b* is described below with reference to FIGS. 6A and 6B. FIGS. 6A and 6B are cross-sectional views of the bearing 500 and its vicinity as viewed in the rotational axis direction of the drive roller shaft 200*b*. FIG. 6A illustrates the bearing 500 that is not deformed, and FIG. 6B illustrates the bearing 500 that is deformed.

The diameter of the drive roller shaft 200*b* is less than the diameter of the hole 500*c* of the bearing 500, and a gap is formed between the drive roller shaft 200*b* and the hole 500*c*. This is because the gap is intentionally formed as an allowance so that a situation is prevented where the drive roller shaft 200*b* cannot pass through the hole 500*c* due to the tolerance or the like. However, the difference in diameter reduces the contact area between the drive roller shaft 200*b* and the hole 500*c* in the circumferential direction of the drive roller shaft 200*b*, which may cause abrasion of the bearing 500 in a sliding section. According to the present embodiment, the bearing 500 is configured to deform and have an increased contact area with the drive roller shaft 200*b*. The structure that enables the bearing 500 to deform is described below.

As described above, the frame 600 has the space 600*b*. The space 600*b* is provided to facilitate deformation of the bearing 500. The hole 500*c* is larger in diameter than the drive roller shaft 200*b* and has a gap therebetween. Consequently, the contact area between the cylindrical portion 500*a* and the drive roller shaft 200*b* is decreased (FIG. 6A). When the cylindrical portion 500*a* is pressed by the driven roller shaft 201*b*, the cylindrical portion 500*a* elastically deforms toward the space 600*b*. Since the cylindrical portion 500*a* deforms toward the space 600*b*, the contact surface of the cylindrical portion 500*a* with the drive roller shaft 200*b* deforms along the circumference of the drive roller shaft 200*b*. As a result, the contact area of the cylindrical portion 500*a* with the drive roller shaft 200*b* increases as compared with when the cylindrical portion 500*a* is not deformed (FIG. 6B).

The space 600*b* is described in more detail below. As described above, when viewed in the rotational axis direction of the drive roller shaft 200*b*, the direction in which the spring 301 urges the driven roller 201*a* is the first direction. The direction perpendicular to the first direction is the second direction, and a region where the drive roller shaft 200*b* is present in the second direction is referred to as a first region 10. Then, the space 600*b* is provided such that the frame 600 and the bearing 500 are not in contact with each other in the first region 10 with the urging force of the spring 301 applied to the bearing 500 from the drive roller shaft 200*b* on the downstream side of the rotation center of the drive roller shaft 200*b* in the urging direction.

That is, the space 600*b* is provided such that the bearing 500 and the frame 600 are not in contact with each other in the first region 10 when the hole 500*c* is deformed along the drive roller shaft 200*b*. In other words, the space 600*b* is provided such that the cylindrical portion 500*a* of the bearing 500 and the frame 600 are not in contact with each other in the first region 10 when the hole 500*c* is deformed along the drive roller shaft 200*b*. This deformation of the cylindrical portion 500*a* prevents a decrease in the contact area between the drive roller shaft 200*b* and the bearing 500 in the circumferential direction of the drive roller shaft 200*b* and, thus, the bearing 500 is less likely to abrade away. Also, the temperature is less likely to increase.

The specific values for the present structure are described below. It is effective to appropriately select the thickness, width, and the like of the cylindrical portion 500*a* in accordance with the shaft diameter of the drive roller shaft 200*b* and the contact force acting on the bearing 500. For example, in the case of the configuration illustrated in FIGS. 6A and 6B, when the bearing material is POM (polyacetal), the shaft diameter is $\phi 6$, and the contact force on the bearing 500 is 2 kilogram-force (kgf), an excellent contact pressure reduction effect can be obtained if the thickness of the cylindrical portion 500*a* is set to 1.2 mm, and the width (the length in the rotational axis direction of the drive roller shaft 200*b*) is set to about 10 mm.

According to the present embodiment, the force acting on the bearing 500 is 1.5 kgf to 2.5 kgf. The thickness and width of the cylindrical portion 500*a* is 1.1 mm to 1.3 mm and 9 mm to 11 mm, respectively.

The present embodiment has been described with reference to the structure of the drive roller shaft 200*b* urged by the spring 301. However, a sliding bearing that is resistant to abrasion and a temperature increase can be achieved when a structure that generates a contact force is employed, such as a structure in which the drive roller shaft 200*b* is tensioned by a belt.

The present embodiment can be applied to any structure of a roller pair that conveys a sheet.

As described above, when the drive roller shaft 200*b* bends, a decrease in the contact area between the drive roller shaft 200*b* and the cylindrical portion 500*a* can be reduced.

Second Embodiment

Figure 7A:
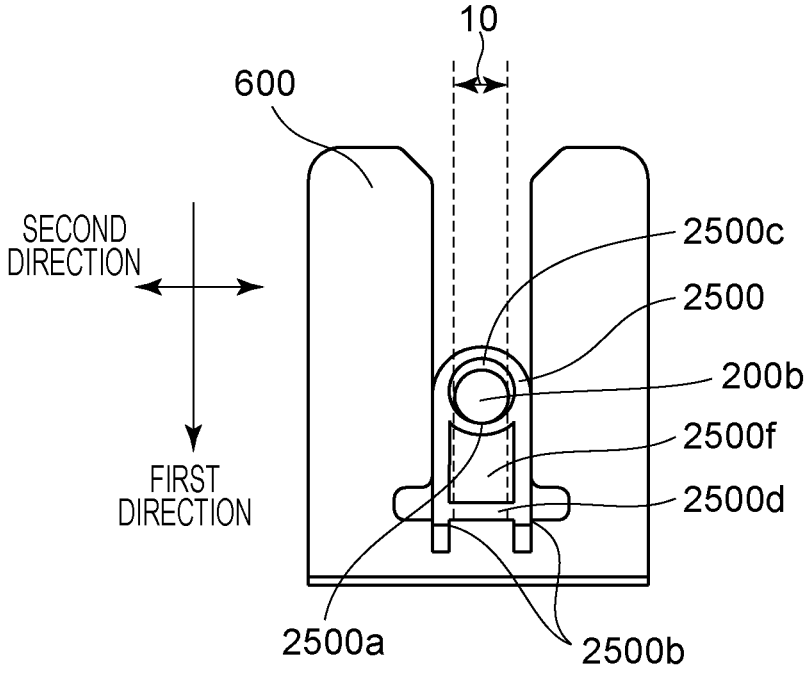
FIGS. 7A and 7B illustrate a bearing according to a second embodiment.
Figure 7B:
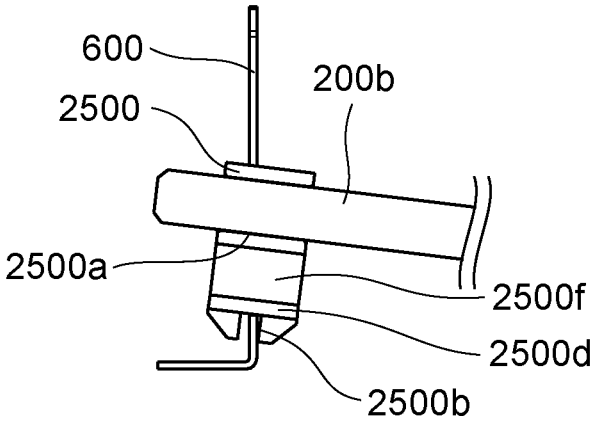

According to the second embodiment, a bearing having another configuration that can obtain an effect the same as in the first embodiment is described with reference to FIGS. 7A and 7B. A part the same as or similar to that in the first embodiment is identified by the same reference numeral, and a description of the part is omitted. FIGS. 7A and 7B illustrate a bearing 2500 according to the second embodiment. FIG. 7A is a cross-sectional view as viewed in the rotational axis direction of the drive roller shaft 200*b*, and FIG. 7B is a side view.

According to the second embodiment, the bearing 2500 corresponding to the bearing 500 according to the first embodiment is used. The bearing 2500 includes a cylindrical portion 2500*a*, a slit 2500*b*, and a hole 2500*c* corresponding to the cylindrical portion 500*a*, the slit 500*b*, and the hole 500*c* according to the first embodiment, respectively. In the present configuration, the slit 2500*b* is located directly below the region of the cylindrical portion 2500*a* in the urging direction.

The bearing 2500 according to the present embodiment has a bottom portion 2500*d* located downstream of the cylindrical portion 2500*a* in the first direction and located inside of the first region 10. The bottom portion 2500*d* is in contact with the frame 600 in the first region 10.

The bearing 2500 has a hole 2500*f* located between the cylindrical portion 2500*a* and the bottom portion 2500*d*. Like the first embodiment, the slit 2500*b* is located near the center of the cylindrical portion 2500*a* in the rotational axis direction of the drive roller shaft 200*b*. The location of the center of the cylindrical portion 2500*a* overlaps the location of the slit 2500*b* in the rotational axis direction of the drive roller shaft 200*b*. The location of the hole 2500*f* overlaps the location of the slit 2500*b* in the rotational axis direction of the drive roller shaft 200*b*. Like the first embodiment, the bearing 2500 can be tilted from the frame 600 as illustrated in FIG. 5B.

When an urging force acts on the cylindrical portion 2500*a* from the drive roller shaft 200*b*, the cylindrical portion 2500*a* is deformed toward the hole 2500*f*. At this time, since the hole 2500*f* is formed, the cylindrical portion 2500*a* and the bottom portion 2500*d* are not in contact with each other in the first direction. Therefore, the cylindrical portion 2500*a* is easily deformed.

Like the structure according to the first embodiment, according to the second embodiment, a decrease in the contact area between the drive roller shaft 200*b* and the cylindrical portion 2500*a* can be reduced when the drive roller shaft 200*b* is bent. By adopting the configuration described in the second embodiment, the same effect as in the first embodiment can be obtained even under conditions where the space on both sides of the bearing is highly restricted.

Third Embodiment

Figure 8A:
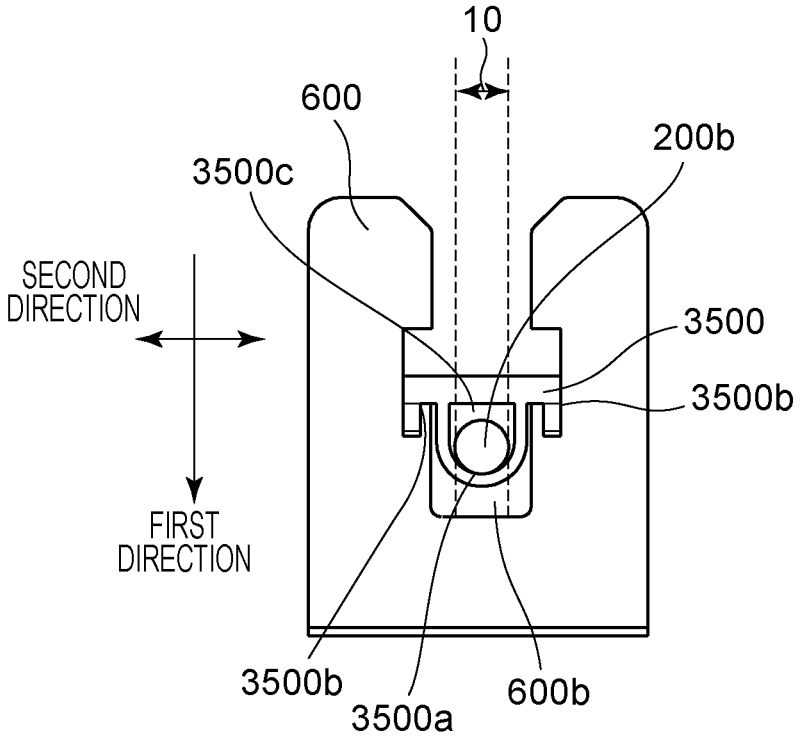
FIGS. 8A and 8B illustrate a bearing according to a third embodiment.
Figure 8B:
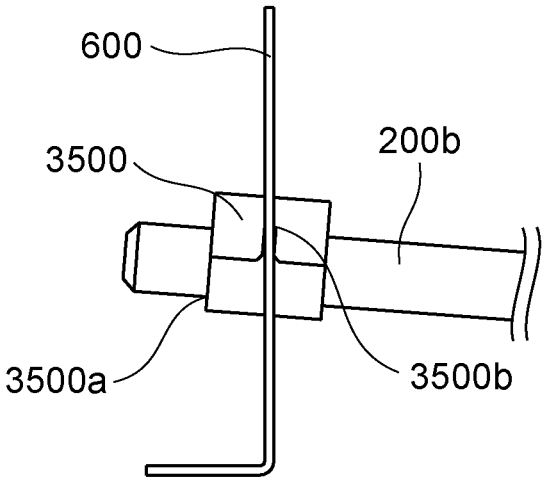

According to the third embodiment, another configuration of the bearing that can achieve the same effect as in the first embodiment is described with reference to FIGS. 8A and 8B. A part the same as or similar to that in the first embodiment is identified by the same reference numeral, and a description of the part is omitted. FIGS. 8A and 8B illustrate a bearing 3500 according to the third embodiment. FIG. 8A is a cross-sectional view as viewed in the rotational axis direction of a drive roller shaft 200*b*, and FIG. 8B is a side view.

According to the third embodiment, the bearing 3500 corresponding to the bearing 500 according to the first embodiment is used. The bearing 3500 includes a receiving portion 3500*a*, a slit 3500*b*, and a hole 3500*c* corresponding to the cylindrical portion 500*a*, the slit 500*b*, and the hole 500*c* according to the first embodiment, respectively.

In this configuration example, the receiving portion 3500*a* has a thin-walled U-shape. Accordingly, the slit 3500*b* is disposed upstream of the center of the bore of the bearing 3500 in the urging direction (the first direction). The slit 3500*b* is disposed near the center of the receiving portion 3500*a* in the rotational axis direction of the drive roller shaft 200*b*. The location of the center of the receiving portion 3500*a* overlaps the location of the slit 3500*b* in the rotational axis direction of the drive roller shaft 200*b*.

When a contact force acts on the receiving portion 3500*a* of the bearing 3500 from the drive roller shaft 200*b*, the entire thin-walled U-shape is elastically deformed and, simultaneously, the receiving portion 3500*a* is elastically deformed toward the space 600*b*. As a result, a decrease in the contact area of the receiving portion 3500*a* with the drive roller shaft 200*b* is reduced. As an effect of elastic deformation of the entire U-shape, the effect can be obtained even under conditions where the contact force is smaller than in the configuration examples of the first embodiment and the second embodiment.

Fourth Embodiment

Figure 9A:
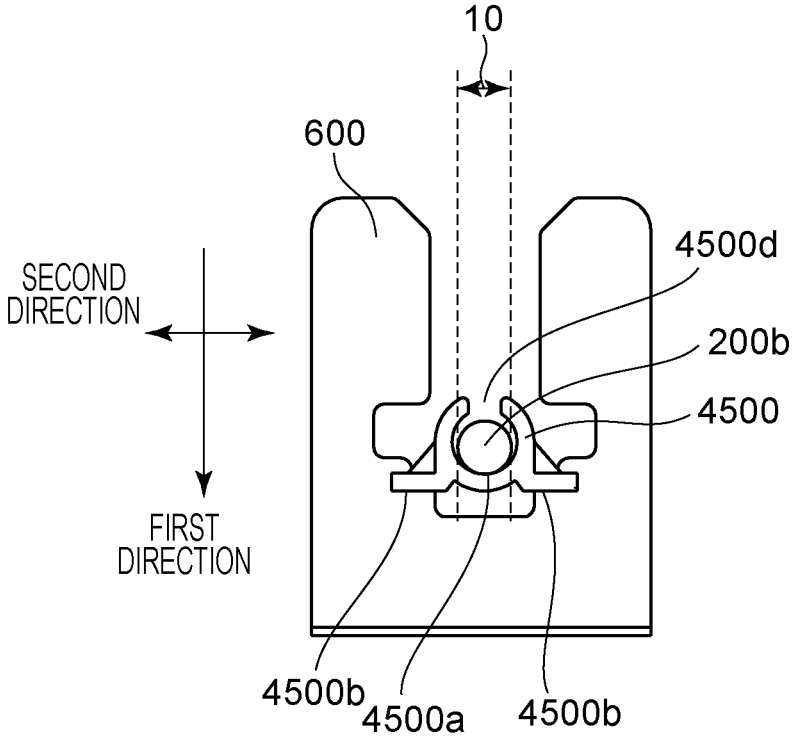
FIGS. 9A and 9B illustrate a bearing according to a fourth embodiment.
Figure 9B:
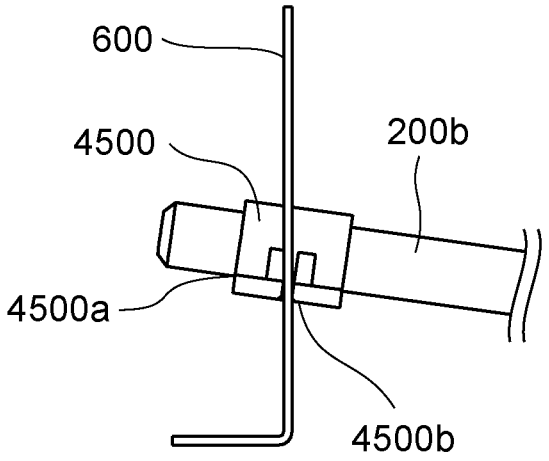

According to the fourth embodiment, another configuration of a bearing that can achieve the same effect as in the first embodiment is described with reference to FIGS. 9A and 9B. A part the same as or similar to that in the first embodiment is identified by the same reference numeral, and a description of the part is omitted. FIGS. 9A and 9B illustrate a bearing 4500 according to the fourth embodiment. FIG. 9A is a cross-sectional view as viewed in the rotational axis direction of a drive roller shaft 200*b*, and FIG. 9B is a side view.

According to the fourth embodiment, the bearing 4500 corresponding to the bearing 500 according to the first embodiment is used. The bearing 4500 includes a receiving portion 4500*a* and a slit 4500*b* corresponding to the cylindrical portion 500*a*, the slit 500*b*, and the hole 500*c* according to the first embodiment.

In this configuration example, a notch 4500*d* is provided upstream of the receiving portion 4500*a* in the first direction, and the slit 4500*b* is disposed downstream of the center of the bore of the bearing 4500 in the first direction. In addition, the slit 4500*b* is disposed near the center of the bearing 4500 in the rotational axis direction of the drive roller shaft 200*b*. The location of the center of the receiving portion 4500*a* overlaps the location of the slit 4500*b* in the rotational axis direction of the drive roller shaft 200*b*.

When the contact force acts on the receiving portion 4500*a* from the drive roller shaft 200*b*, the receiving portion 4500*a* deforms so that the width of the notch 4500*d* decreases. By adopting the structure illustrated in FIGS. 9A and 9B, the same effect as in the first embodiment can be obtained even under conditions where the contact force is further reduced, as compared with the configurations of the first to third embodiments.

Appropriate effects can be obtained by selecting the bearing configuration in accordance with the design constraints and device specifications.

The sheet conveyance device including the bearing can reduce a decrease in the contact area between the roller shaft and the bearing and, thus, reduce abrasion of the bearing.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-169648 filed Oct. 24, 2022, which is hereby incorporated by reference herein in its entirety.

What is claimed is:

1. A sheet conveyance device comprising:

a frame;

a first roller configured to convey a sheet;

a roller shaft configured to hold the first roller;

a second roller configured to face the first roller and nip the sheet together with the first roller;

an urging member configured to urge the second roller toward the first roller in a direction intersecting a rotational axis direction of the roller shaft; and a bearing including a holding portion configured to slidably hold the roller shaft and held by the frame, wherein the holding portion is deformable, wherein, as viewed in the rotational axis direction of the roller shaft, a direction in which the urging member urges the second roller is defined as a first direction, a direction that is perpendicular to the first direction is defined as a second direction, and a region where the roller shaft is present in the second direction is defined as a first region, wherein the frame holds the bearing so as not to be in contact with the holding portion in the first region downstream of a rotation center of the roller shaft in the first direction, wherein the bearing includes an arm having a slit that is configured to engage with the frame and extends in the first direction, wherein the bearing has a first surface and a second surface that form the slit, and the first surface and the second surface are disposed so as to face each other and sandwich the frame, and wherein, when one of the first surface and the second surface is in contact with the frame, a gap is formed between the other of the first surface and the second surface and the frame.

2. The sheet conveyance device according to claim 1, wherein the bearing has a third surface that forms the slit, and wherein the third surface is in contact with the frame such that the bearing is positioned in place relative to the frame in the first direction.

3. The sheet conveyance device according to claim 2, wherein displacement of the holding portion from the frame is allowed in a direction from the frame to the first roller upstream of the third surface in the first direction.

4. The sheet conveyance device according to claim 1, wherein the first roller and the second roller are located upstream of an image forming section configured to form an image on the sheet in a sheet conveyance path, and wherein the first roller and the second roller form a registration roller pair configured to correct skew of the sheet.

5. A sheet conveyance device comprising:

a frame;

a first roller configured to convey a sheet;

a roller shaft configured to hold the first roller;

a second roller configured to face the first roller and nip the sheet together with the first roller;

an urging member configured to urge the second roller toward the first roller; and a bearing that includes a holding portion configured to slidably hold the roller shaft and a bottom portion in contact with the frame and that is held by the frame, wherein the holding portion is deformable, wherein, as viewed in a rotational axis direction of the roller shaft, a direction in which the urging member urges the second roller is defined as a first direction, a direction that is perpendicular to the first direction is defined as a second direction, and a region where the roller shaft is present in the second direction is defined as a first region, wherein the bottom portion is located downstream of the holding portion in the first direction and is located inside of the first region, wherein the bearing has a hole disposed between the holding portion and the bottom portion so that the holding portion is not in contact with the bottom portion in the first region, wherein the bearing includes an arm having a slit that is configured to engage with the frame and extends in the first direction, wherein the bearing has a first surface and a second surface that form the slit, and the first surface and the second surface are disposed so as to face each other and sandwich the frame, and wherein, when one of the first surface and the second surface is in contact with the frame, a gap is formed between the other of the first surface and the second surface and the frame.

6. The sheet conveyance device according to claim 5, wherein the bearing has a third surface that forms the slit, and wherein the third surface is in contact with the frame such that the bearing is positioned in place relative to the frame in the first direction.

7. The sheet conveyance device according to claim 6, wherein displacement of the holding portion from the frame is allowed in a direction from the frame to the first roller upstream of the third surface in the first direction.

8. The sheet conveyance device according to claim 5, wherein the first roller and the second roller are located upstream of an image forming section configured to form an image on the sheet in a sheet conveyance path, and wherein the first roller and the second roller form a registration roller pair configured to correct skew of the sheet.

* * * * *